US011168691B2

(12) United States Patent
Heaps et al.

(10) Patent No.: US 11,168,691 B2
(45) Date of Patent: Nov. 9, 2021

(54) ROTARY VACUUM PUMP WITH A ROTOR END GROOVE

(71) Applicant: WABCO Europe BVBA, Brussels (BE)

(72) Inventors: David Heaps, Haworth (GB); Phillip Saxton, Morley Leeds (GB); Peter Todman, Upper Poppleton York (GB)

(73) Assignee: ZF CV SYSTEMS EUROPE BV, Brussels (BE)

( * ) Notice: Subject to any disclaimer, the term of this patent is extended or adjusted under 35 U.S.C. 154(b) by 151 days.

(21) Appl. No.: 16/340,152

(22) PCT Filed: Oct. 10, 2016

(86) PCT No.: PCT/EP2016/001672
§ 371 (c)(1),
(2) Date: Apr. 8, 2019

(87) PCT Pub. No.: WO2018/068806
PCT Pub. Date: Apr. 19, 2018

(65) Prior Publication Data
US 2019/0242383 A1 Aug. 8, 2019

(51) Int. Cl.
*F04C 29/06* (2006.01)
*F04C 25/02* (2006.01)
(Continued)

(52) U.S. Cl.
CPC ..... *F04C 29/06* (2013.01); *F01C 21/10* (2013.01); *F04C 18/344* (2013.01); *F04C 25/02* (2013.01);
(Continued)

(58) Field of Classification Search
CPC ..... F04C 29/06; F04C 27/005; F04C 25/02; F04C 29/02; F04C 18/344; F04C 27/006;
(Continued)

(56) References Cited

U.S. PATENT DOCUMENTS 3,065,707 A * 11/1962 Ziskal ..... F04C 15/0088 418/81
3,936,238 A * 2/1976 Wycliffe ..... F01C 21/10 417/312
(Continued)

FOREIGN PATENT DOCUMENTS

EP 2151542 A2 2/2010
GB 2158517 A 11/1985
(Continued)

OTHER PUBLICATIONS

English Machine Translation of JPH1068393A. Translated on Nov. 1, 2020. (Year: 1998).*
English Machine Translation of JP2014-074368A (Year: 2014).*

*Primary Examiner* — Mary Davis
*Assistant Examiner* — Paul W Thiede
(74) *Attorney, Agent, or Firm* — Leydig, Voit & Mayer, Ltd.

(57) ABSTRACT

A rotary vacuum pump includes a housing defining a pump chamber therein and a rotor extending through a first axial end panel into the pump chamber and carrying at least one vane for rotary movement of the vane within the pump chamber. The rotor comprises an annular axial end face configured to seal against a corresponding contact surface of a second axial end panel. An annular groove for reducing noise generation of the rotary vacuum pump during operation is formed at the annular axial end face of the rotor and/or the contact surface of the second axial end panel.

17 Claims, 4 Drawing Sheets

(51) Int. Cl.

| | |
|---|---|
| ***F04C 29/02*** | (2006.01) |
| ***F04C 18/344*** | (2006.01) |
| ***F04C 27/00*** | (2006.01) |
| ***F01C 21/10*** | (2006.01) |

(52) U.S. Cl.
CPC ..... *F04C 27/005* (2013.01); *F04C 29/02* (2013.01); *F04C 27/006* (2013.01); *F04C 2220/10* (2013.01); *F04C 2240/20* (2013.01)

(58) Field of Classification Search
CPC ..... F04C 2240/54; F04C 2220/10; F04C 2240/20; F04C 15/0088; F01C 21/108; F01C 21/10
See application file for complete search history.

(56) References Cited

U.S. PATENT DOCUMENTS

| | | | | |
|---|---|---|---|---|
| 4,080,122 A | | 3/1978 | Skrivanek et al. | |
| 4,209,287 A | | 6/1980 | Takada | |
| 4,507,065 A | * | 3/1985 | Shibuya | F04C 29/02 418/15 |
| 4,795,325 A | * | 1/1989 | Kishi | F01C 21/08 418/14 |
| 5,011,520 A | * | 4/1991 | Carr | B01D 47/08 261/116 |

FOREIGN PATENT DOCUMENTS

| | | | |
|---|---|---|---|
| JP | H 1068393 A | | 3/1998 |
| JP | 2014074368 A | * | 4/2014 |

* cited by examiner

ROTARY VACUUM PUMP WITH A ROTOR END GROOVE

CROSS REFERENCE TO RELATED APPLICATIONS

This application is a U.S. National Stage Application under 35 U.S.C. § 371 of International Application No. PCT/EP2017/001672 filed on Oct. 10, 2016. The International Application was published in English on Apr. 19, 2018 as WO 2018/068806 A1 under PCT Article 21(2).

FIELD

The invention relates to a rotary vacuum pump comprising a housing defining a pump chamber therein, and a rotor extending through a first axial end panel into the pump chamber and carrying at least one vane for rotary movement of the vane within the pump chamber, the rotor comprising an annular axial end face sealing against a corresponding contact surface of a second axial end panel. Moreover, the invention relates to a use of such a rotary vacuum pump.

BACKGROUND

Vacuum pumps of the aforementioned type may be fitted to road vehicles with gasoline or diesel engines. Typically, the vacuum pump is driven by a cam shaft of the engine. Therefore, in most vehicles the vacuum pump is mounted to an upper region of the engine. But also configurations where the vacuum pump is mounted to a lower region of the engine are known, in these cases the vacuum pump might for example be driven by an electric motor. In general, two different construction types of vacuum pumps are known, one is the type incorporating a movable piston, and the other is the vane pump. Nowadays, in particular vane pumps are broadly established.

The vane pump of the aforementioned type typically comprises a housing having an inlet and an outlet and defining a chamber within the housing. Moreover, it comprises a rotor for rotational movement about a rotational axis within the chamber. The rotor is usually offset with respect to a central axis of the housing, and typically mounted adjacent, or contacting, an inner circumferential wall of the chamber. The rotor drives at least one vane to draw fluid through the inlet into the chamber and out of the chamber through the outlet, so as to induce a reduction and pressure at the inlet. The inlet is connectable to a consumer such as a brake booster or the like. The outlet normally is connected to the engines crank case, thus the exhaust air is consumed by the engine via the PCV system.

Known in the art are so-called mono vane pumps or single vane pumps, comprising one single vane which extends in a radial direction through the whole rotor, so as to project outward on both sides of the rotor and to contact with both vane tips the inner circumferential wall of the chamber. Moreover, also multi vane pumps are known which have a plurality of vanes which are provided in radial or non-radial manner in the rotor and movable independent from each other. With such multi vane pumps, the inner circumferential wall and thus the chamber profile can be designed with a great degree of freedom.

SUMMARY

In an embodiment, the present invention provides a rotary vacuum pump. The rotary vacuum pump includes a housing defining a pump chamber therein, and a rotor extending through a first axial end panel into the pump chamber and carrying at least one vane for rotary movement of the vane within the pump chamber. The rotor comprises an annular axial end face configured to seal against a corresponding contact surface of a second axial end panel. An annular groove for reducing noise generation of the rotary vacuum pump during operation is formed at the annular axial end face of the rotor and/or the contact surface of the second axial end panel.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
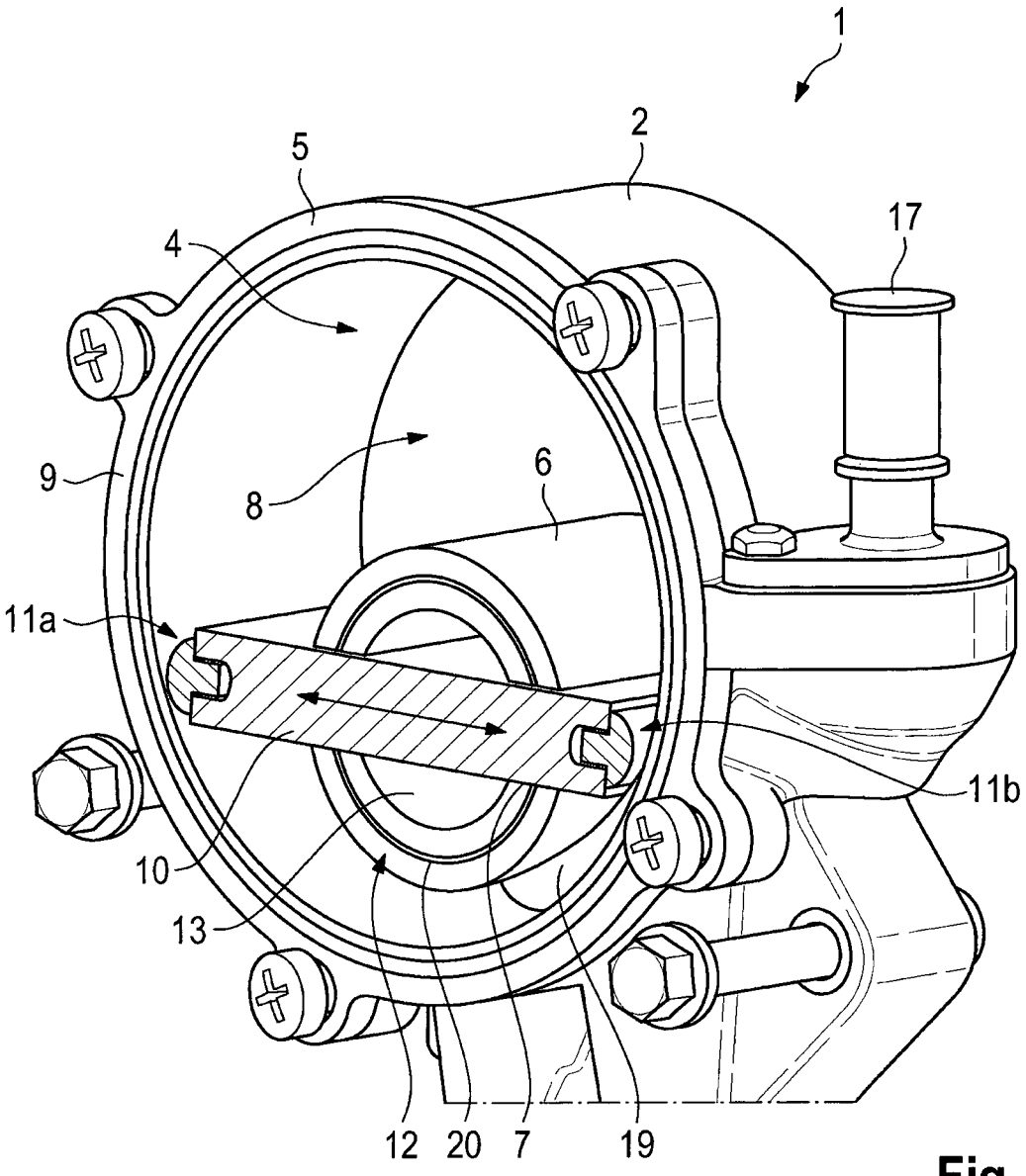
FIG. 1 shows a perspective view of a rotary vacuum pump with a demounted axial end panel.

The rotor of vane pumps in general is cup-shaped and has a rotor shaft, which extends through a first axial end panel, normally a bottom wall, of the pump chamber. The pump chamber itself also is cup-shaped and closable by a lid which defines a second axial end panel. The cup-shaped part of the rotor has a diameter larger than the drive shaft and thus, the rotor is held within the pump chamber.

Upon rotation of the rotor the vane moves back and forth and draws fluid into the cavity and through the inlet and pushes fluid out of the cavity through the outlet. Due to this rotation action, the load on the rotor varies, dependent on the rotational position and also dependent on the pressure at the inlet. This varying load may result in an axial movement of the rotor which causes a beating noise which may be recognizable by a user of the vehicle, or pedestrians standing close to the vehicle.

Embodiments of the invention provide rotary vacuum pumps in which noise emission is reduced. Various embodiments of the invention provide both mono vane pumps and multi vane pumps.

According to a first aspect of the invention, a rotary vacuum pump of the aforementioned type is provided having an annular groove for reducing noise generation of the rotary vacuum pump during operation, wherein said groove is formed at the axial end face of the rotor and/or the contact surface of the second axial end panel.

The inventors of the present invention have found that such a groove promotes flow of a fluid, such as air or lubricating medium between the rotor and the axial end panel and thus acts as a "pillow" for the rotor. When the rotor is loaded in an axial direction, the rotor seats on the fluid "pillow" and thus noise generation is reduced.

Herein, it is important that the groove is not too large and not too small. If the groove is too large, the effect of damping a rocking or beating action of the rotor against the respective contact surface is not reduced sufficiently, since the lubricant simply "sinks" into the groove. If the groove is too small, the promotion of lubricant is not effective enough, which also leads to the effect that noise reduction is not achieved sufficiently.

According to a first preferred embodiment, the groove is formed such that when filled with a lubricating medium during operation, contact between the rotor and the second axial end panel is substantially prevented. Thus, the rotor actually does not contact the respective end face, but is carried by the lubricating medium which is held in the groove. When pressing the rotor in the axial direction, lubricating medium is forced to flow away from the contact surface and this flow is fed by the lubricating medium supplied by the groove and thus there is a small film of lubricating medium between the rotor end face and the respective contact surface of the second axial end panel.

Preferably, the groove has a rounded bottom portion. This helps to supply lubricating medium, when the rotor is forced against the axial end panel.

Moreover, it is preferred that the groove is closed in radial direction. Thus, the groove is formed into the axial end face of the rotor or the contact surface of the second axial end panel, and has two side walls and a bottom. The side walls of the groove preferably have the same height and thus the groove is closed in radial direction. This closure in radial direction prevents the lubricating medium flowing into radial direction and thus helps to keep the lubricating medium within the contact area and thus also supports the effect of the rotor swimming on the lubricating medium.

Particularly preferred, the groove is asymmetrical. When the groove is asymmetrical, the groove can be formed such that flow out of the groove into a direction, radial outwardly or radial inwardly, can be controlled. It has been shown that it is important to form the groove such that a lubricating "pillow" is stably kept between the rotor and the respective contact surface.

According to a further preferred development of the invention, the groove has a tapered side surface which tapers off in at least one radial direction. Thus, the respective ball forming the tapered side surface of the groove is not formed in a parallel manner with a rotational axis of the rotor, but at an oblique angle. The respective side surface might be formed in a frustroconical manner, or tapering with a continuous curvature, as to slightly taper off in at least one radial direction. This also helps to provide a lubricating medium flowing between the rotor and the respective panel, for providing the noise-reducing effect.

Preferably, the side surface tapers off radial outwardly. This is in particular preferred when the groove is formed at the rotor. In such embodiment, the groove rotates together with the rotor, thus accelerating the lubricating medium which is held inside the groove. The rotation of this medium causes a centrifugal force on the medium, resulting in a radial force drawing the medium out of the groove and into a contact area between the rotor and the respective end face. Thus, when the side surface tapers radial outwardly, flow of the lubricating medium out of the groove and into the area between the groove and the end face is promoted.

Moreover, it is preferred that the side surface includes an angle with a plane perpendicular to a rotary axis of the rotor in the range of 5° to 35°, in particular 10° to 30°, more preferably 15° to 25°, even more preferred 15° to 20°. In particular, the range of 15° to 20° is preferred, since it has shown to provide a good noise-reducing effect. However, also an effect can be achieved in the range of 5° to 35°, even though the effect is not as strong as in the range of 15° to 20°.

According to a further preferred embodiment, the groove is substantially arranged centrally with respect to a rotor wall, preferably at a central annular line of the rotor and/or at the center of gravity of the rotor wall. In case the groove is formed at the contact surface of the second axial end panel, it is formed accordingly, in a mirrored manner with respect to the annular center line of the rotor. This arrangement of the rotor provides the supporting pillow effect at the center of gravity of the rotor wall and thus helps to keep the rotor in a stable position.

Moreover, it is preferred that the groove has a circular rounded portion. The circular rounded portion preferably has a radius of 0.2 to 1.0 mm, in particular 0.2 to 0.6 mm, preferably substantially amounts to 0.4 mm. Also this rounded portion helps to provide a stable noise-reducing effect.

According to a further preferred embodiment, the groove has a depth of 0.1 to 0.6 mm, in particular 0.2 mm. The range of 0.2 mm has shown to be sufficient to provide a substantial noise-reducing effect for most rotary vacuum pumps, as they are used for vehicle, such as trucks. In case the groove is too deep, too much lubricating medium is required to fill the groove for providing the "pillow effect".

According to a second aspect of the invention, an annular groove is provided for reducing noise generation of a rotary vacuum pump during operation, wherein the groove is formed at an axial end face of the rotor and/or at a contact surface of an axial end panel of the vacuum pump. The vacuum pump preferably is formed as a vacuum pump stated in the introductory portion of the present application. Preferably, the groove is filled with a lubricating medium during operation. Moreover, it is preferred that the reduction of noise generation is at least by 10%, preferably 20%, more preferably 30%, even more preferred 40%. This noise reduction is measured with respect to a vacuum pump without such an annular groove and measured at a speed up to 500 rpm and a maximum vacuum level measured at the inlet of the vacuum pump of full or near to full vacuum, e.g. a level of 90 kPa or more with respect to a standard atmospheric pressure of 0 kPa (absolute standard atmosphere at 101.3 kPa). In the past it has shown that noise generation is at the highest level, when the maximum achievable vacuum level of the specific pump is reached. This maximum vacuum level typically is in the range of 90 kPa to 100 kPa, dependent on clearances and manufacturing tolerances. The operational speed of vacuum pumps in this sector typically is in the range of 300 rpm to 500 rpm. Higher speed also tends to increase noise generation. It is preferred that the noise reduction measurement is carried out at about 300 rpm or the nominal operational speed, and after reaching the maximum vacuum level of the pump. The 'maximum vacuum achievable by the pump' being preferably defined as: The vacuum level achieved by a pump, when evacuating a 'leak free' 1 liter vacuum reservoir, for a period of 5 minutes, with the pump operating under the following conditions: operational speed 300 rpm, oil supply pressure of 1 bar and oil temperature 90° C. Other parameters are preferably standard, e.g. 23° C. air temperature.

It shall be understood that the rotary vacuum pump of the first aspect and the use of the second aspect of the present invention comprise identical and similar aspects. In so far, reference is made to the above description, features and technical effects of the rotary vacuum pump according to the first aspect of the invention.

According to an embodiment of the present invention, the rotary vacuum pump 1 comprises a housing 2 which defines a pump chamber 4 therein. The housing 2 is substantially cup-shaped, having a first axial end panel 8 which forms a bottom and a radial sidewall 5 which terminates at a rim 9.

Figure 3:
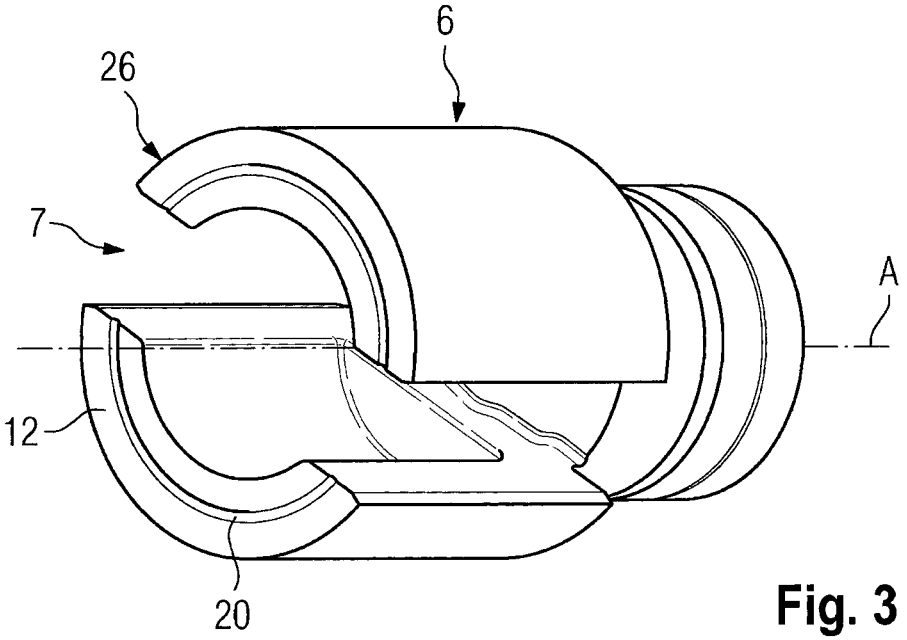
FIG. 3 shows a perspective view of a rotor.

Within the chamber 4 a rotor 6 is provided which will be described in more detail with respect to FIGS. 3, 4 and 5 below.

The rotor 6 comprises a radial slot 7 into which, according to this embodiment, a mono vane 10 is seated. The mono vane 10 can slide in the direction of the arrow shown in FIG. 1 upon rotation of the rotor 6. The rotor 6 is fixed with respect to its rotational axis A (see FIG. 3) inside the chamber 4 and forces the vane 10 to slide back and forth upon rotation. The vane 10 is provided with two sealing portions 11*a*, 11*b* at their axial tips which contact the inner wall of chamber 4. In so far, this construction is known in the art.

Rotor 6 comprises an axial end face 12 and defines an inner cavity 13 therein. The inner cavity 13 of rotor 6 has the main purpose to reduce weight of the rotor 6. The rotor 6 needs to have a certain radial extension, to on the one hand have a sealing point with the inner circumferential wall of the chamber and on the other hand have a rotational axis which is enough offset from the inner wall, to provide a movement of the vane 10.

Figure 2:
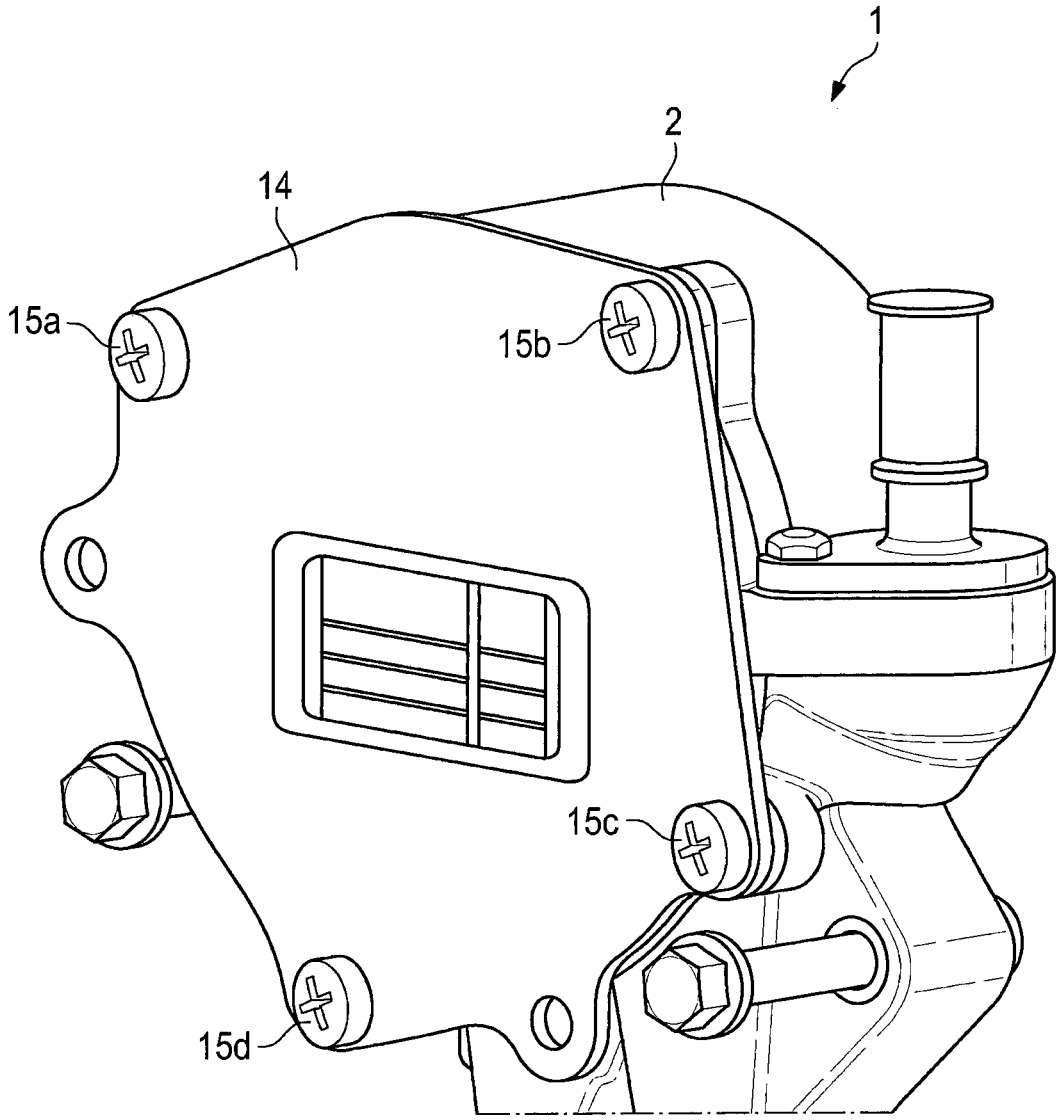
FIG. 2 shows the perspective view of FIG. 1 with mounted axial end panel.

The chamber 4 normally is closed during operation by means of a second axial end panel 14 (see FIG. 2) which is fixed against the rim 5 by means of screws 15*a*, 15*b*, 15*c*, 15*d*.

When the rotor 6 rotates and the vane draws fluid through the inlet 17 into the cavity and pushes fluid out of the chamber 4 through the outlet 19, a rocking motion around the cantilevered rotor bearing is created which causes the rotor 6 to impact with its axial end face 12 the axial end panel 14. These impact events are audible in the form of a series of random taps or knocks and can be heard by occupants of the vehicle and bystanders.

Therefore, according to the present invention, the rotor end face 12 comprises a groove 20 for reducing noise generation of the rotary vacuum pump during operation. In an alternative embodiment, the groove 20 (which is described in more detail below) is symmetrically formed in the axial end panel 14. It shall be contemplated that this is also an embodiment of the present invention, even though it is not shown in the figures.

The groove 20 runs along a middle portion of the axial end face 12, and is arranged centrally with respect to the rotor wall 26. The groove 20 is called "annular groove", even though it is interrupted by the slot 7 formed in the rotor 6 for receiving the vane 10. Thus, the term "annular groove" can also be considered as being an "interrupted annular groove". In case the groove 20 is formed in the panel 14, it can be completely circumferential and annular. However, the groove 20 does not comprise any artificial walls or interruptions, so that the groove 20 is segmented. Much more, the lubrication medium can flow completely through the groove 20.

Figure 4:
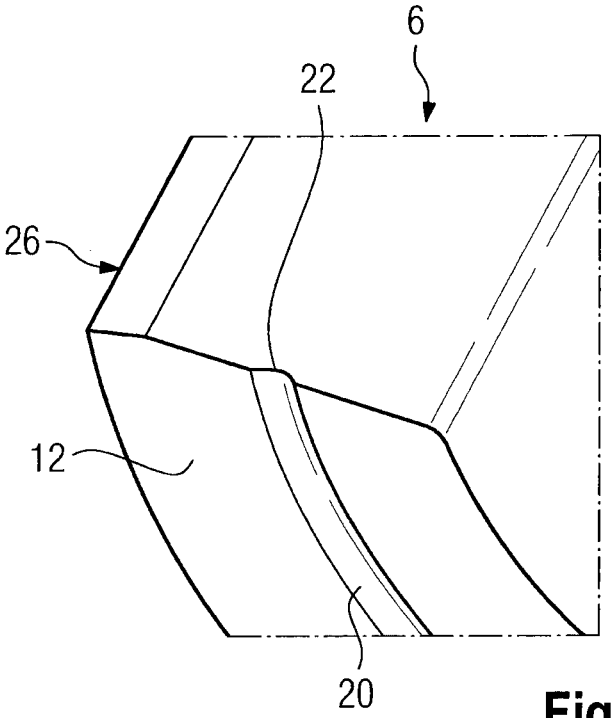
FIG. 4 shows a detail of FIG. 3.

As can be seen in particular in FIG. 4, groove 20 comprises a rounded bottom portion 22 and is formed as an slight depression in the axial end face 12. The particular form of the groove can be seen in FIG. 5.

Figure 5:
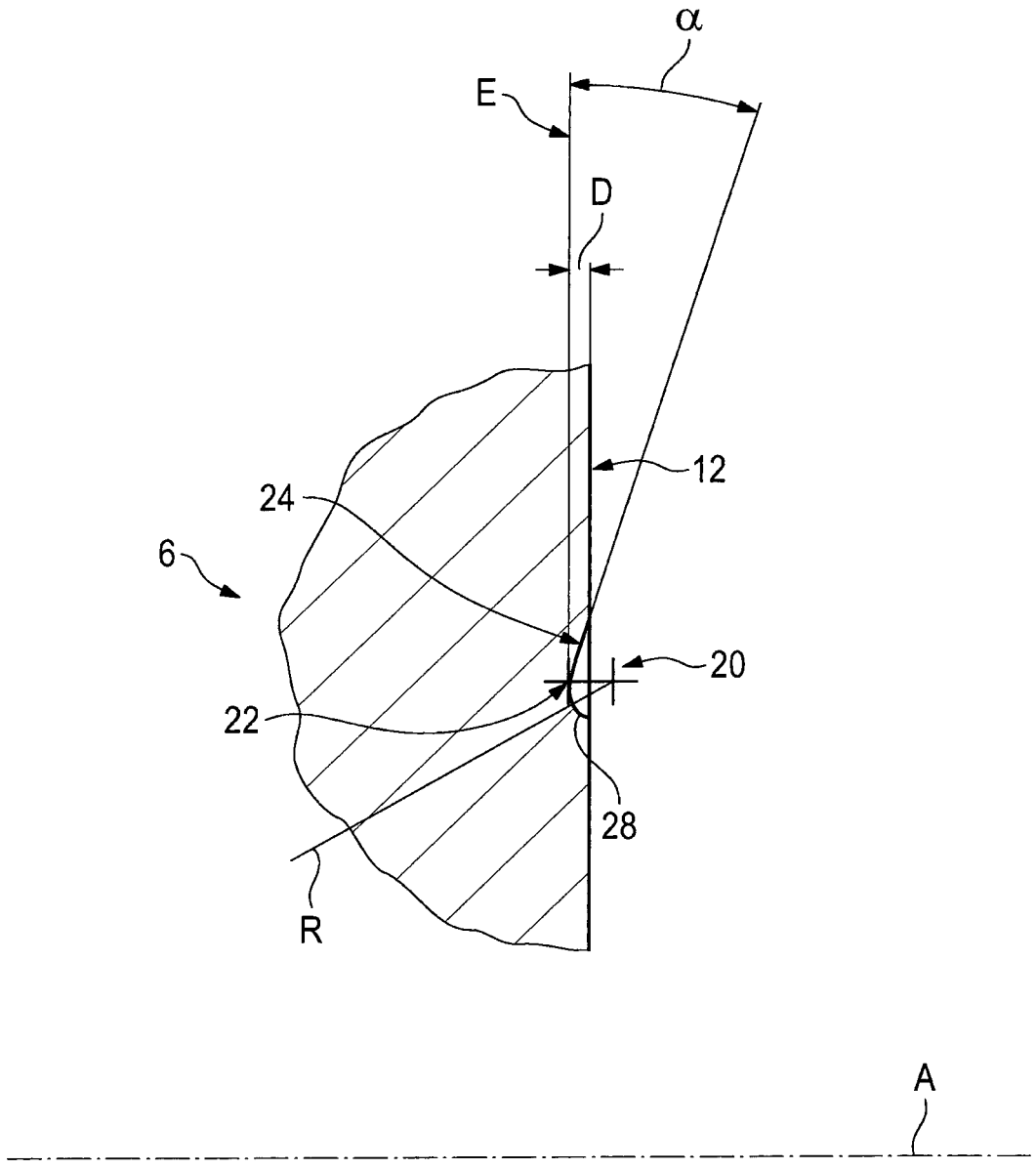
FIG. 5 shows a cut view of a detail of the rotor highlighting the groove.

In FIG. 5, a section of the rotor 6 is shown in a cross-sectional view with respect to rotational axis A. The groove 20 comprises a rounded bottom portion 22, a side surface 24 and a circular rounded portion 28. The circular rounded portion 28 forms a radial inner sidewall of the groove, and the side surface 24 a radially outer sidewall. The groove 20 is radially completely closed, that is it comprises two walls 24, 28 which in general extend to the same height as on both sides.

The circular portion 28 merges into the round bottom portion 22 which in turn merges into the sidewall 24 which tapers off to the axial end face 12. The rounded portion 28 according to this embodiment comprises a radius of 0.4 mm. The depth D of the groove 20 in total is 0.2 mm. The side surface 24 has an angle $\alpha$ with the plane of the rotor end face 12 of 18°. In general, this geometry leads to the effect that when the rotor 6 is pressed against the end panel 14, lubricant medium is pressed into the groove 20 and forced out of it and flows along the side 24 building a film between the end face 12 and the end panel 14. The specific form of the groove, according to this embodiment, has a nozzle-type effect due to the cross section reduction in the radial direction which creates an increased flow velocity of the lubricant medium and at the same time a pressure reduction. Due to this effect, damping of the noise, due to damping of the taps and knocks of the rotor 6 against the end panel 14 is effectively reduced.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SIGNS

1 rotary vacuum pump
2 housing
4 pump chamber
5 radial sidewall
6 rotor
7 radial slot
8 first axial end panel
9 rim
10 mono vane
11*a*, 11*b* sealing portions
12 axial end face
13 inner cavity
14 second axial end panel
15*a*, 15*b*, 15*c*, 15*d* screws

17 inlet
19 outlet
20 groove
22 rounded bottom portion
24 side surface
26 rotor wall
28 circular rounded portion
A rotation axis
D depth
E plane
R radius
α angle

The invention claimed is:

1. A rotary vacuum pump, comprising:

a housing defining a pump chamber therein, the housing including a first axial end panel and a second axial end panel; and a rotor extending through the first axial end panel into the pump chamber, the rotor including:

a slot configured to carry at least one vane for rotary movement of the at least one vane within the pump chamber, an annular axial end face configured to seal against a corresponding contact surface of the second axial end panel, the annular axial end face having a radially inner perimeter and a radially outer perimeter, and an asymmetrical annular groove for reducing noise generation of the rotary vacuum pump during operation, the asymmetrical annular groove being formed on the annular axial end face of the rotor, the asymmetrical annular groove being disposed, in a radial direction, centrally between the radially inner perimeter and the radially outer perimeter, and the asymmetrical annular groove being interrupted by the slot.

2. The rotary vacuum pump according to claim 1, wherein the asymmetrical annular groove is formed such that, during operation of the rotary vacuum pump, a lubricating medium fills the asymmetrical annular groove and substantially prevents contact between the rotor and the second axial end panel.

3. The rotary vacuum pump according to claim 1, wherein the asymmetrical annular groove has a rounded bottom portion.

4. The rotary vacuum pump according to claim 1, wherein the asymmetrical annular groove is closed in a radial direction.

5. The rotary vacuum pump according to claim 1, wherein the asymmetrical annular groove has a tapered side surface which tapers off in at least one radial direction.

6. The rotary vacuum pump according to claim 1, wherein the asymmetrical annular groove has a circular portion.

7. The rotary vacuum pump according to claim 6, wherein the asymmetrical annular groove has a depth, in an axial direction, that varies in the radial direction, and wherein the radially varying depth continuously decreases, in the radially outer direction, from a first depth of the asymmetrical annular groove at a radially inner end of the tapered side surface to a depth of zero at a radially outer end of the tapered side surface.

8. The rotary vacuum pump according to claim 7, wherein the asymmetrical annular groove includes a circular portion, and wherein, in the circular portion, the radially varying depth increases, in the radially outer direction, from a depth of zero at a radially inner end of the circular portion to a depth of a radially outer end of the circular portion.

9. The rotary vacuum pump according to claim 5, wherein the side surface includes an angle with a plane perpendicular to a rotary axis of the rotor in a range of 5° to 35°.

10. The rotary vacuum pump according to claim 1, wherein the groove has a circular portion.

11. The rotary vacuum pump according to claim 10, wherein the circular portion has a radius of 0.2 mm to 1.0 mm.

12. The rotary vacuum pump according to claim 1, wherein the asymmetrical annular groove has a depth of 0.1 mm to 0.6 mm.

13. The rotary vacuum pump according to claim 1, wherein the slot is formed, at least in part, by at least one axially extending upper wall and at least one axially extending lower wall, wherein the axially extending upper wall and the axially extending lower wall both extend, from the annular axial end face of the rotor toward the first axial end panel, and wherein the asymmetrical annular groove is interrupted by the slot on the at least one axially extending lower wall and the at least one axially extending upper wall.

14. The rotary vacuum pump according to claim 13, wherein a cross section of the asymmetrical annular groove intersects with the at least one axially extending lower wall and the at least one axially extending upper wall.

15. A method for reducing noise generation of a rotary vacuum pump during operation, the method comprising:

providing a rotary vacuum pump including:

a housing defining a pump chamber therein, the housing including a first axial end panel and a second axial end panel, and a rotor extending through the first axial end panel into the pump chamber, the rotor including: a slot configured to carry at least one vane for rotary movement of the at least one vane within the pump chamber, an annular axial end face configured to seal against a corresponding contact surface of the second axial end panel, the annular axial end face having a radially inner perimeter and a radially outer perimeter; and forming an asymmetrical annular groove on the annular axial end face of the rotor for reducing noise generation of the rotary vacuum pump during operation, the asymmetrical annular groove being disposed, in a radial direction, centrally between the radially inner perimeter and the radially outer perimeter, the asymmetrical annular groove being interrupted by the slot.

16. The method according to claim 15, wherein, during the operation of the rotary vacuum pump, the asymmetrical annular groove is filled with a lubricating medium.

17. The method according to claim 15, wherein the reduction of noise generation, as measured with respect to a rotary vacuum pump without an asymmetrical annular groove, is at least 10%.

* * * * *